US005211030A

United States Patent [19]

Jameson

[11] Patent Number: 5,211,030

[45] Date of Patent: May 18, 1993

[54] APPARATUS FOR STORING AND DISPENSING ICE

[75] Inventor: William M. Jameson, Coopersburg, Pa.

[73] Assignee: Follett Corporation, Easton, Pa.

[21] Appl. No.: 749,114

[22] Filed: Aug. 23, 1991

[51] Int. Cl.[5] ..... F25C 5/18

[52] U.S. Cl. ..... 62/344; 222/561; 414/328

[58] Field of Search ..... 62/344; 414/328, 329, 414/397, 401; 222/559, 561

[56] References Cited

U.S. PATENT DOCUMENTS

| | | | |
|---|---|---|---|
| 178,489 | 6/1876 | Unkrich | 141/364 |
| 232,141 | 9/1880 | Moseley | 141/364 |
| 555,034 | 2/1896 | Berg | 141/364 |
| 1,018,924 | 2/1912 | Patnaude | 141/364 |
| 2,774,393 | 12/1956 | Swan | 141/18 |
| 2,866,322 | 12/1958 | Muffly | 62/344 X |
| 3,045,442 | 7/1962 | Durham | 62/71 |
| 3,096,900 | 7/1963 | Breneman | 220/4 |
| 3,118,559 | 1/1964 | Stricker | 220/9 |
| 3,237,873 | 3/1966 | Raski | 241/27 |
| 3,913,343 | 10/1975 | Rowland et al. | 62/137 |
| 3,937,365 | 2/1976 | Shelley et al. | 222/241 |
| 4,006,557 | 2/1977 | Sawyer | 47/61 |
| 4,042,142 | 8/1977 | Ruano | 220/4 B |
| 4,171,716 | 10/1979 | Szabo et al. | 141/364 |
| 4,209,999 | 7/1980 | Falk et al. | 62/344 |
| 4,300,359 | 11/1981 | Koeneman et al. | 62/344 X |
| 4,386,700 | 6/1983 | Deaton | 206/507 |
| 4,557,406 | 12/1985 | Olinger et al. | 222/564 |
| 4,595,094 | 6/1986 | Reid | 206/45.14 |
| 4,699,188 | 10/1987 | Baker et al. | 141/18 |
| 4,746,034 | 5/1988 | Ata et al. | 222/143 |
| 4,785,958 | 11/1988 | Snyder | 220/5 A |
| 4,840,284 | 6/1989 | Snyder | 220/5 A |
| 4,881,378 | 11/1989 | Bryant | 62/344 X |
| 4,942,979 | 7/1990 | Linstromberg et al. | 62/340 |

OTHER PUBLICATIONS

Kloppenberger Owner's Manual, author and date unknown.

*Primary Examiner*—William E. Tapolcai
*Attorney, Agent, or Firm*—Paul & Paul

[57] ABSTRACT

The present invention provides a novel ice storing and dispensing apparatus having drainage means therein for removing melted ice from areas in which ice is to be stored or contained. The apparatus further includes a portable cart having a front actuated draining mechanism which is adapted to discharge any ice melt which may accumulate in the cart into the apparatus drainage means.

18 Claims, 4 Drawing Sheets

APPARATUS FOR STORING AND DISPENSING ICE

FIELD OF THE INVENTION

The present invention relates to an ice-making, storing and dispensing apparatus provided with a drainage means for removing melted ice therefrom.

BACKGROUND OF THE INVENTION

Ice has long been provided in many forms to meet various commercial demands. Among the many forms of ice are cubes, blocks, shavings, or chips available within the commercial market. Ice is widely and popularly used, for example, in supermarkets, restaurants, hotels, marinas, recreational centers, and other facilities. For example, ice can be used in display cases where perishable items are to be openly viewed, as well as placed in glasses for chilling beverages.

Generally, sizable quantities of particulate ice are stored within a bin to facilitate the availability of the ice, so that the amount of ice needed in a given instance may be removed from the bin. Once ice has been made, whether as ice shavings, cubes, cylinders, etc., such particles usually reside within a holding bin until dispensed. When ice particles are deposited in the holding bin they often collide with one another causing fragmentation. The ice fragments, being relatively small in size, readily melt when encountering surfaces of the holding bin, thereby causing a build-up of melted ice to accumulate at the bottom of the holding bin. The fragmenting effect is even enhanced when the ice bin is accessed or when ice is dispensed, since warmer air from outside of the ice storage compartment is able to enter and partially melt the contained ice, including both ice fragments and the larger pieces of ice residing therein. Other contributions to the melting of ice are effectuated by the insertion into the bin of a user's hand, as well as any tools, which generally are of a temperature well above that of the ice bin and any ice contained therein. The melted ice accumulation at the bottom of a storage bin is also problematic for another reason. That is, ice sitting in this water may also be prone to melting, thereby reducing the overall volume and hence, the efficiency of the ice-making machine.

SUMMARY OF THE INVENTION

The present invention is directed to providing an apparatus for storing and dispensing ice including a novel drainage system for removing melted ice from areas in which ice is to be stored for use. Trough or gutter means are provided within the ice storing machine for receiving the melted ice which would otherwise remain within a storage bin. A movable receptacle adapted to also drain its melted ice into the gutter means is also provided.

It is an object of the present invention to provide an ice storing and dispensing apparatus having novel drainage means and with or without ice making features.

It is a further object of the present invention to provide an ice storing and dispensing apparatus having a movable receptacle wherein said receptacle comprises means for ice storage.

It is another object of the present invention to provide a bottom-draining movable receptacle with a front-actuated drainage valve means.

Another object of the present invention is to provide an ice storing and dispensing apparatus having a drainage system into which melted ice from a movable receptacle may drain.

A further object of the present invention is to provide means for selective draining of said movable receptacle when positioned to receive product therein.

BRIEF DESCRIPTION OF THE PREFERRED EMBODIMENTS

DETAILED DESCRIPTION OF THE PREFERRED EMBODIMENTS

Figure 1:
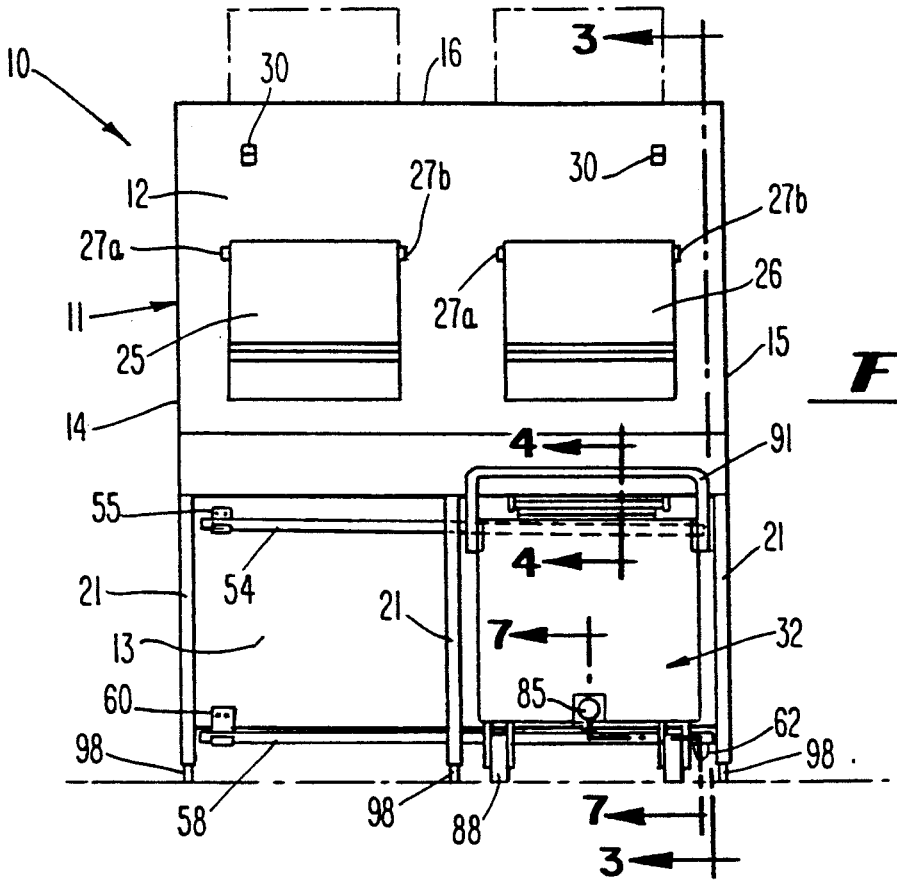
FIG. 1 is a front elevational view showing the present ice storing and dispensing apparatus with a portable storage receptacle, with ice making equipment being shown in phantom thereabove.

FIG. 1 shows an embodiment of the present ice storing and dispensing apparatus 10. A bin 11 is provided having a front wall 12, a rear wall 13, a pair of side walls 14 and 15, a top wall 16, and a sloped floor 17, the floor comprised of spaced apart upper and lower floor portions 18 and 18', for insulation purposes. The walls and floor thereby define an ice compartment 20 therein. A plurality of vertical leg members 21 are shown extending from and supporting the bin 11 off the floor (shown in phantom).

The bin 11 accommodates a pair of ice makers (shown in phantom above top wall 16) for delivering ice into compartment 20, with the lower portion of said compartment 20 comprising a first storage means for holding a quantity of ice therein. The bin 11 is preferably insulated and may further be provided with a suitable means (not shown) for regulating and maintaining a bin temperature of about a minimum of 32° F., or preferably lower.

Figure 2:
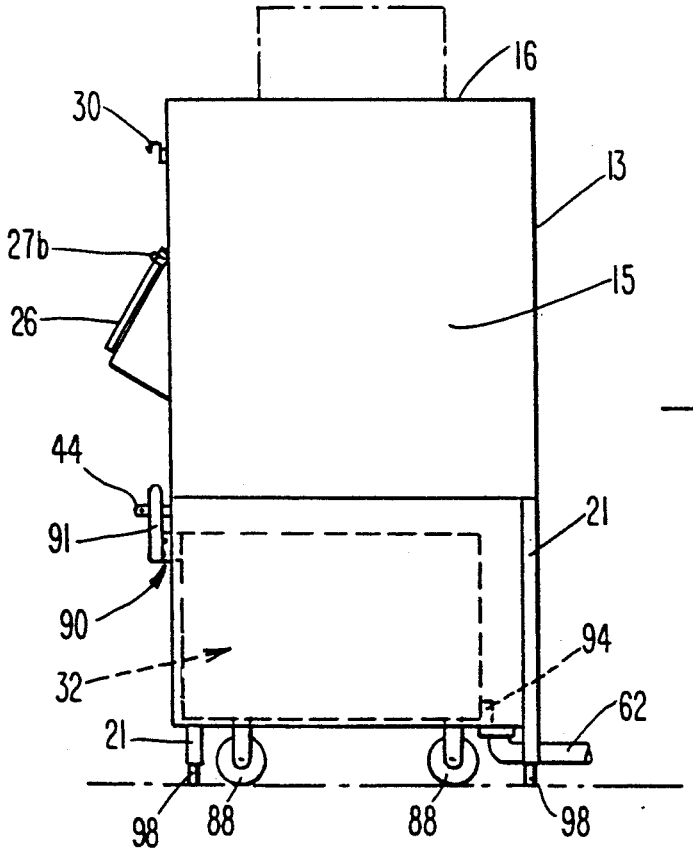
FIG. 2 is a right side elevational view of the apparatus shown in FIG. 1.
Figure 3:
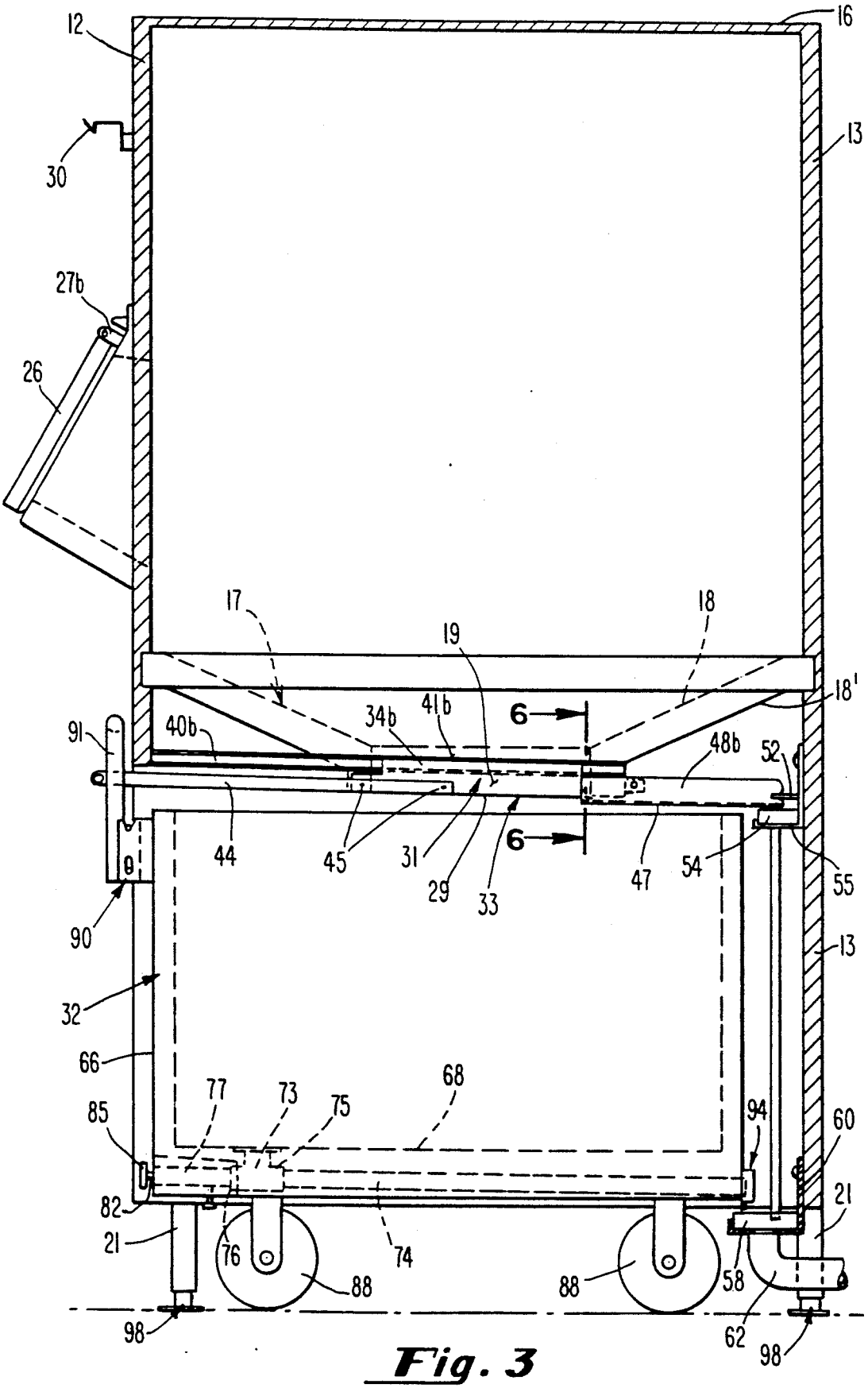
FIG. 3 is an enlarged sectional view of the present apparatus taken along the line 3—3 of FIG. 1.

Access means are provided for facilitating the removal of ice from the bin, for example, comprising doors 25 and 26, shown in FIGS. 1-3. Each door 25, 26 pivots on hinge pairs 27*a, b* and may be retained in an opened position by a door catch generally 30, disposed above each said door 25, 26, to permit entry into the bin compartment 20 for ice removal or cleaning.

A hopper or gate assembly 31 is shown in FIG. 3 providing a means for regulating the passage of ice from the compartment 20 of the first storage means into a movable receptacle 32, which, for example, may comprise a second storage means. The receptacle may be positioned under said bin 11 for receiving a quantity of ice therein, for removal, and optionally to provide space in addition to that of the bin storage compartment 20, for the manufactured ice products to occupy. The movable receptacle 32 may be positioned such that the space between the top edge of the receptacle and the plane of the opening 19 in the floor of the bin 11 is no more than one eighth of an inch, for reasons of hygiene and cleanliness. Alternate spacing arrangements (not shown) of the various walls in relation to the bin 3 is made possible by modifications consistent with the teachings of the present invention as described herein.

Figure 4:
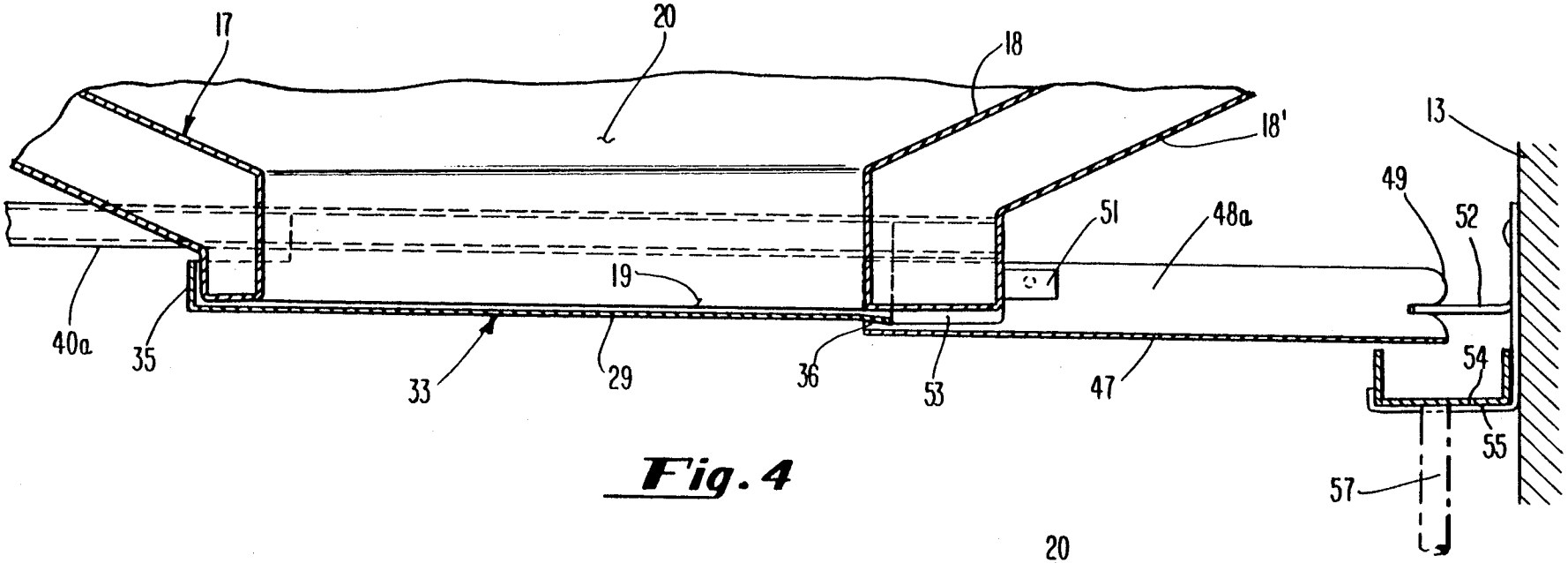
FIG. 4 is an enlarged fragmentary sectional view generally along line 4—4 of FIG. 1, showing the slidable gate member of the hopper assembly and drainage means, the gate member being in its closed condition.

A slidable gate door member 33 is shown forming, in part, the bottom floor of the ice bin 11 at the center thereof, the remainder of the bin bottom being defined by sloping floor portions 18. The slide member 33 is provided having a generally U-shaped cross-sectional configuration in FIG. 6, including a gate door 29 and pair of upwardly extending wall portions 34*a, b,* with the gate door edge closest to the front of said ice bin 11 having a connecting wall portion 35 disposed between and connecting said wall portions 34*a, b,* with the opposite or rear gate door shelf edge 36, as shown in FIG. 4, being slightly downwardly sloped to comprise a means for directing a flow of melted ice onto a drainage shelf 47, also sloped downwardly to the rear, and at the same time to minimize potential backflow of ice melt along the underside of said gate 33, which might otherwise drain into the contents of the movable receptacle 32.

The gate assembly 31 is further provided with a track assembly 38 which retains the gate member 33 and permits sliding movement of said gate member 33 to regulate between open (FIG. 5) and closed (FIG. 4) positions, the gate member 33 also being capable of occupying a variety of positions (not shown) between fully open and fully closed. The track assembly 38 is shown (FIG. 6) comprising a pair of outwardly opening U-shaped tracks 40*a, b,* each of which is disposed within a pair of respective grooves 41*a, b* furnished in the lower sloped floor portions 18' of the bin 11. The slide bar members 43*a,* 43*b* may be secured to upstanding flanges 34*a,* 34*b* of gate 33 by any suitable fastening means such as for example, welds 42*a, b,* to thereby carry the gate 33 in sliding relation in tracks 41*a,* 41*b*.

Figure 6:
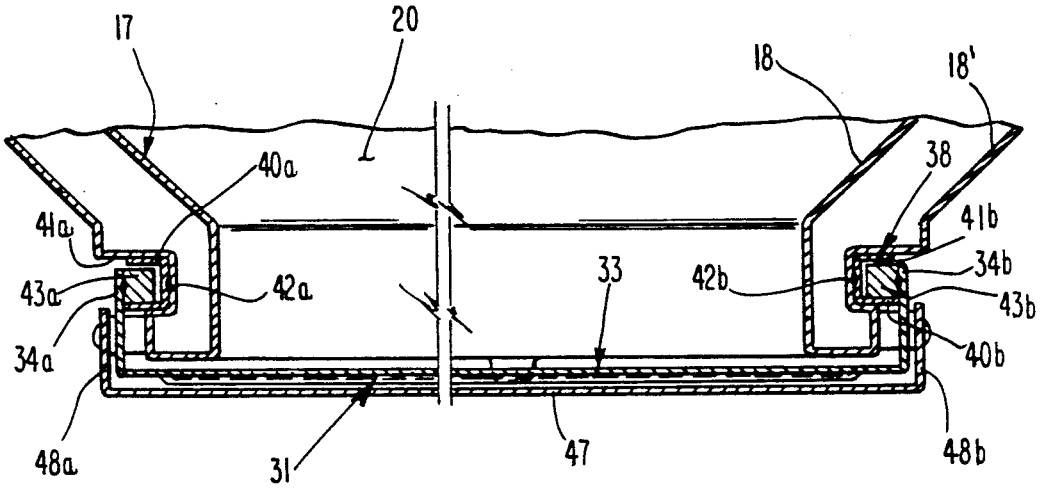
FIG. 6 is a fragmentary transverse sectional elevational view taken along the line 6—6 of FIG. 3 showing the hopper gate assembly.

Referring to FIGS. 3 and 6, track members 40*a,* 40*b,* that form track grooves 41*a,* 41*b,* extend from the vicinity of the central opening 19 to the front bin wall 12 to allow for the gate member 33 to be withdrawn leftward as viewed in FIG. 3 at least an amount sufficient to permit an opening of the central area 19 covered by said gate 33.

A handle 44, which is connected to the gate 33 by any suitable fastener means, such as for example those rivets 45 shown in FIG. 3, is also provided to comprise means for moving gate 33 along tracks 40*a, b.* Although only one side of the gate assembly 31 is shown in FIG. 3, similar connecting means not shown would be employed to fasten the handle on the opposite side, as well. When the gate is opened as in FIG. 5, the handle 44 is pivoted 90° clockwise from its position shown in FIG. 3, about fastener points 45, to be generally vertically disposed against the front wall of the apparatus, to be out of the way in a non-projecting manner.

Figure 5:
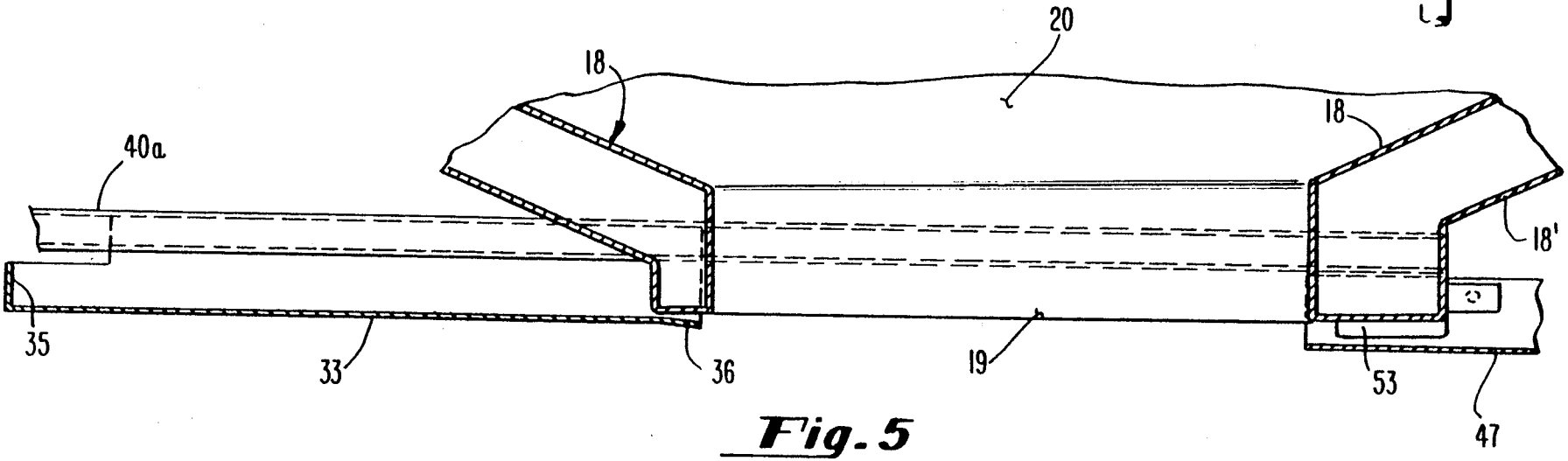
FIG. 5 is an enlarged fragmentary sectional view like FIG. 4, but with the gate member being in its opened condition.

Reference now being made to FIGS. 4 and 5, the operation of the gate assembly 31 is described in conjunction with the apparatus drainage assembly. FIG. 5 shows the gate member 33 in its opened condition whereby both ice, as well as melted ice, may freely pass out of the bin compartment 20, into the area beneath said compartment.

A drainage shelf 47 having a pair of opposed upstanding walls 48*a, b* (FIG. 6) is seen disposed beneath said bin floor portion 18, 18' such that when said gate member 33 is in its closed condition thereby extending beyond said bin floor opening 19, said sloped shelf 47 resides below at least part of, and preferably the edge 36, of said gate member 33 in order to receive any melted ice which might drain off of said sloped gate member 33.

The drainage shelf 47 is provided to be of a width greater than that of the gate shelf member 33, as seen in FIG. 6. Any suitable mounting means may be employed to retain the drainage shelf 47 in position, such as for example the bracket members 51 and 52 shown in FIG. 4. The drainage shelf 47 is thus mounted to provide a sloped surface across which ice melt may travel, the rear of said shelf 47 preferably being positioned at a lower height in relation to its front. The upstanding flange 35 (FIG. 4) of drainage shelf 47 acts as a stop when the gate member 33 is fully closed.

The rear of the shelf 47 ends at 49, a slight distance away from the rear wall 13 of the bin 11 to provide clearance for exiting ice melt as shown in FIG. 4. Melted ice is delivered via said shelf 47 into the upper drainage trough or gutter 54, which is supported on the rear bin wall 13 immediately below the drainage shelf 47 by the use of any suitable mounting means, such as for example, the trough brackets 55 (FIGS. 1 and 4). Preferably, the upper trough 54 is sloped downwardly to the right as seen in FIG. 1 to encourage melted ice to drain into the vertical connecting pipe 57 (shown in phantom in FIG. 4), and thereafter into a lower trough 58 (FIG. 3), which is itself supported by trough brackets members 60, which preferably are mounted to provide a similar slope or grade for the lower trough 58 to that of upper trough 54. The melted ice from the storage compartment 20 ultimately drains out of the apparatus 10 by way of the outlet duct 62.

A second product storage means is provided to receive and store a quantity of ice therein. The second storage means preferably may comprise a movable receptacle 32 of the cart type, having insulated walled construction including a pair of side walls (unnumbered), connecting front and rear walls 66, 67, and a floor or bottom 68 further having drainage means comprising receptacle drain assembly 70.

Figure 7:
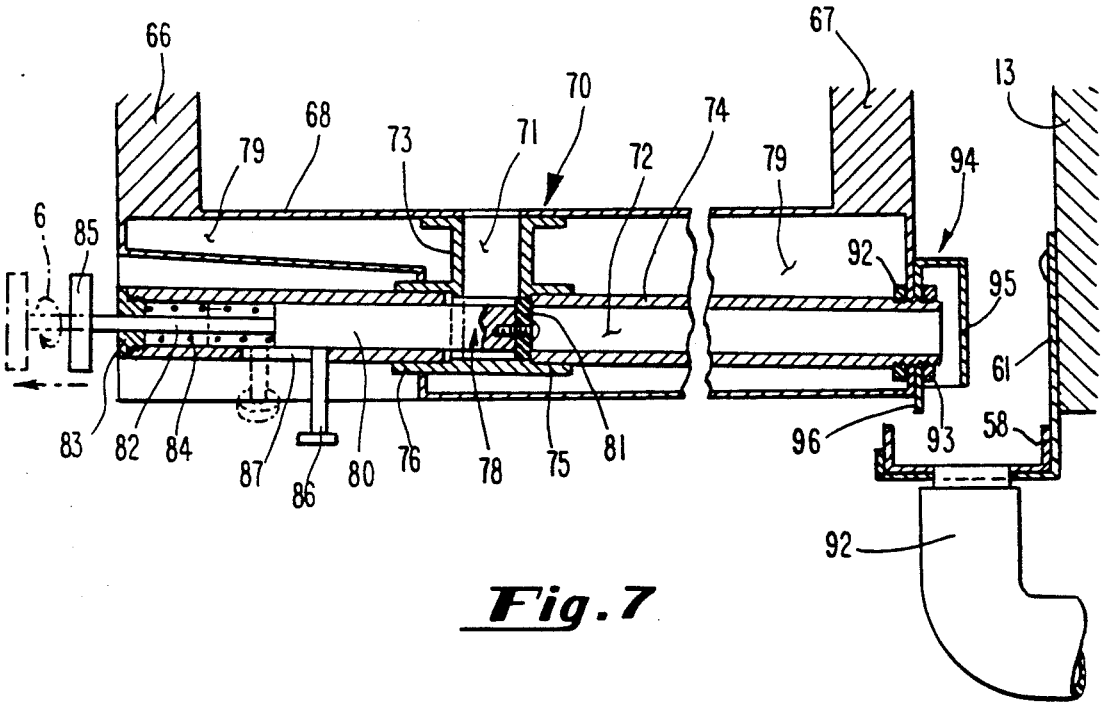
FIG. 7 is an enlarged fragmentary sectional view generally along line 7—7 of FIG. 1 through the movable receptacle drain, showing the draining mechanism of the present apparatus.

The drainage means including the receptacle drain assembly 70 is seen with more detail in FIG. 7. The floor 68 of the receptacle 32 is shown having a vertical tubular opening 71 in communication with a horizontally sloped pipe-like opening 72, said openings being defined by duct members 73 and 74, respectively.

Duct member 73 is a generally inverted T-shaped fitting with one arm 75 of the T-shaped member 73 being directed toward the rear of the cart 32 and receiving horizontal duct member 74 therein, and the oppositely directed arm 76 receiving hollow duct member 77 which extends to the front wall 66 of said cart 32. Duct member 77 houses a retractable plunger assembly 78 therein.

The plunger assembly 78 comprises a cylinder 80 having a flat rubber-like washer 81 mounted at one end thereof for disposition against the left end of duct 74 in sealing-closed relation. Alternatively, a tapered right end (not shown) could be provided inside a tapered left end of duct 74, with an "O" ring therebetween, and thereby could provide an openable closure seal. Also, other alternative openable/closeable seal arrangements could be provided for duct 74. There is a rod 82 extending from the opposite end of said cylinder 80; said rod 82 extending through a cap member 83 which is received within the front wall 66 of the receptacle 32. A spring member 84 is disposed about the rod 82 in the area between the cylinder 80 and the cap member 83 for urging the plunger cylinder 80 sealingly closed against the left end of duct member 74 (FIG. 7) when the drain assembly 70 is to be in its closed position, as seen in the full-line view of FIG. 7. When closed, the plunger cylinder 80 provides a barrier to melted ice accumulating in the channel 71, so as to prevent any transport of the same through the channel 72.

The selective draining capability for the cart 32 is regulated with the control knob 85 located at the front of the receptacle 32. To open the drain 70, the cylinder 80 is retracted by pulling the knob 85 away from the front wall 66 of the receptacle 32. A locking means is provided comprising a pin member 86 which is connected to and extends from the cylinder 80 through a slotted opening 87 in duct member 77, said opening 87 being L-shaped such that when knob 85 is retracted to the phantom-line position and rotated in the direction indicated by arrow "b", the retaining pin 86 resides in the arm of the L-slot 87 (as shown in phantom) to permit the flow of melted ice to pass from the vertical channel 71 to the horizontal channel 72. Although it would appear that empty space 79 is shown in the zone immediately surrounding the ducts of the drain assembly 20, it is understood that insulating material may also occupy the spaces consistent with the present teachings.

The cart 32 is shown supported on wheels 88 which enable the receptacle to transport its contents to a desired area or location of use. A pivotally collapsible handle assembly 90 is also provided, including a handle 91 which will preferably be in a vertical position (FIG. 3) for transport, but which can be pivoted 180° counterclockwise from the position shown in FIG. 3 for unloading (not shown).

In FIG. 7 the hollow duct member 74 which defines the opening 72 is shown extending from the T-shaped duct 73 and through the rear wall 67 of the cart 32, said duct 73 being secured by mounting collar members 92 and 93. The terminal end of duct 74, for example, may be threaded for receiving collar members 92 and 93, which may also be matingly threaded.

A flow guide 94 is shown mounted over the end portion of the duct 77 where melted ice is to exit. The flow guide 94 comprises a backwall 95 against which exiting flow can be controlled. A flanged portion 96 is also provided at the lower portion of the flow guide 94 for deflecting and directing melted ice into the targeted lower gutter member 58 into which the storage compartment 20 also drains. An outlet duct 62 allows for the ultimate removal of melted ice from the apparatus, for carrying the flow of ice melt to a waste drain (not shown).

Although gutters 54 and 58, as well as the drainage shelf 47, may be installed in a slightly sloped condition as discussed herein to encourage proper direction of the draining melted ice as it flows through the series of transport means discussed above adjustment feet 98 are also provided on each leg and can further facilitate obtaining the necessary pitches of gutters, 54 and 58, and gate member 33 in order to promote adequate drainage, as well as to align the apparatus 10.

It will be understood from a reading of the detailed description of the preferred embodiments, the objects of the invention and the appended claims that further modifications of the present invention may be made consistent with the scope of the subject matter as taught by the present invention which is to be broadly construed in view of the claims appended hereto. For example, while the embodiment shown in FIG. 2 illustrates two side-by-side access doors 25,26, for access to bin portions having bottom bin openings 19 bearing, for discharge into a pair of carts disposed therebeneath, it will be understood that any number of access doors/discharge openings/cart arrangements, from one to three, four or more may be utilized, as desired, depending upon the needs of the user. Additionally, in connection with this invention, but not specifically comprising a part thereof, suitable windows or the like, sliding or otherwise openable may be provided on one or more walls of the apparatus, such as on the front wall 12, for access to the bin for cleaning, ice discharge, or the like. Similiarly, while details of particular valving arrangements, handles and the like are shown in the drawings and discussed in the application, it will be understood that the present invention is intended to cover equivalents thereof. Further, while particular details of construction of various components of the apparatus are disclosed herein, various alternative arrangements may be employed. Other modifications and changes in construction of the various components of this invention may also be modified within the spirit and scope of the invention as recited in the appended claims.

We claim:

1. An apparatus for storing and dispensing ice comprising:

a) first means disposed in said apparatus for storing manufactured ice therein;

b) a zone in the apparatus below said first means, for accommodating a second means to be disposed in said apparatus for storing manufactured ice therein;

c) wherein said first ice storing means is provided with drainage means carried thereby for removing melted ice therefrom, and means for connecting a said second storing means when the second storing means is disposed in said zone, for melted ice from the second storing means to drain into the drainage means of the first sorting means; and d) wherein said second storing means is included as part of said apparatus, and wherein said second storing means includes a movable receptacle having a floor with an opening therein to permit the flow of melted ice to exit from said receptacle.

2. The apparatus of claim 1, wherein said first storage means includes a hopper assembly having retractable gate means movable between opened and closed positions for selectively permitting a quantity of ice to be dispensed therefrom when in its open position, said gate means when in its closed position being adapted to receive melted ice and deliver said melted ice to said drainage means.

3. The apparatus of claim 1, wherein said second ice storing means is adapted for disposition beneath said first storing means, said first storing means defining a generally enclosed compartment being accessible by at least one closable opening, said compartment being supported by support means which extends below said compartment and carries said drainage means thereon.

4. The apparatus of claim 3, wherein said drainage means includes trough means extending below said compartment for channeling melted ice, said trough means being adapted to receive melted ice from said first storing means and from said second storing means.

5. The apparatus of claim 1, wherein said second storing means comprises a movable receptacle for receiving and storing ice therein, said receptacle having drain means for allowing the exit of fluids therefrom, wherein said drain means includes a duct-like opening in communication with the interior of said receptacle floor to provide a means for fluid to exit from said receptacle, there being a valve operably disposed relative to said duct-like opening for regulating fluid flow through said opening, said valve being operable from the front of said receptacle.

6. The apparatus of claim 1, further including ice making means disposed to communicate with said first storage means to dispense a quantity of ice therein.

7. The apparatus of claim 1, wherein said second ice storing means is adapted for disposition beneath said first storing means, said first storing means defining a generally enclosed compartment being accessible by at least one closable opening, said compartment being supported by support means which extends below said compartment and caries said drainage means thereon;

wherein said drainage means includes trough means extending below said compartment for channeling melted ice, said trough means being adapted to receive melted ice from said first storing means and from said second storing means;

wherein said trough means includes at least two horizontally disposed gutter members, said members being sloped to provide direction for said melted ice flow, wherein at least one said gutter member is provided to drain into a second gutter member.

8. An apparatus for storing and dispensing ice comprising:

a) first means disposed in said apparatus for storing manufactured ice therein;

b) a zone in the apparatus below said first means, for accommodating a second means to be disposed in said apparatus for storing manufactured ice therein;

c) wherein said first ice storing means is provided with drainage means carried thereby for removing melted ice therefrom, and means for connecting a said second storing means when the second storing means is disposed in said zone, for melted ice from the second storing means to drain into the drainage means of the first storing means; and d) wherein said first storage means includes a hopper assembly having retractable gate means movable between opened and closed positions for selectively permitting a quantity of ice to be dispensed therefrom when in its open position, said gate means when in its closed position being adapted to receive melted ice and deliver said melted ice to said drainage means.

9. An apparatus for storing and dispensing ice comprising:

a) first means disposed in said apparatus for storing manufactured ice therein;

b) a zone in the apparatus below said first means, for accommodating a second means to be disposed in said apparatus for storing manufactured ice therein;

c) wherein said first ice storing means is provided with drainage means carried thereby for removing melted ice therefrom, and means for connecting a said second storing means when the second storing means is disposed in said zone, for melted ice from the second storing means to drain into the drainage means of the first storing means; and d) wherein said second ice storing means is adapted for disposition beneath said first storing means, said first storing means defining a generally enclosed compartment being accessible by at least one closable opening, said compartment being supported by support means which extends below said compartment and carries said drainage means thereon;

e) wherein said drainage means includes trough means extending below said compartment for channeling melted ice, said trough means being adapted to receive melted ice from said first storing means and from said second storing means;

f) wherein said trough means includes at least two horizontally disposed gutter members, said members being sloped to provide direction for said melted ice flow, wherein at least one said gutter member is provided to drain into a second gutter member.

10. The apparatus of any one of claims 7 or 9, wherein said second storing means is adapted to drain into said second gutter member; said second gutter having an outlet for drainage of fluid therefrom to the outside of said apparatus.

11. An apparatus for storing and dispensing ice comprising:

a) first means disposed in said apparatus for storing manufactured ice therein;

b) a zone in the apparatus below said first means, for accommodating a second means to be disposed in said apparatus for storing manufactured ice therein;

c) wherein said first ice storing means is provided with drainage means carried thereby for removing melted ice therefrom, and means for connecting a said second storing means when the second storing means is disposed in said zone, for melted ice from the second storing means to drain into the drainage means of the first storing means; and d) wherein said second storing means comprises a movable receptacle for receiving and storing ice therein, said receptacle having drain means for allowing the exit of fluids therefrom, wherein said drain means includes a duct-like opening in communication with the interior of said receptacle floor to provide a means for fluid to exit from said receptacle, there being a valve operably disposed relative to said duct-like opening for regulating fluid flow through said opening, said valve being operable from the front of said receptacle.

12. An apparatus for storing and dispensing ice comprising:

a) first means disposed in said apparatus for storing manufactured ice therein;

b) a zone in the apparatus below said first means, for accommodating a second means to be disposed in said apparatus for storing manufactured ice therein;

c) wherein said first ice storing means is provided with drainage means carried thereby for removing melted ice therefrom, and means for connecting a said second storing means when the second storing means is disposed in said zone, for melted ice from the second storing means to drain into the drainage means of the first storing means; and d) wherein said second storing means is included as part of said apparatus and wherein said second storing means is removably provided.

13. The apparatus of claim 12, wherein said second ice storing means is adapted for disposition beneath said first storing means, said first storing means defining a generally enclosed compartment being accessible by at least one closeable opening, said compartment being supported by support means which extends below said compartment and carries said drainage means thereon.

14. The apparatus of claim 13, wherein said drainage means includes trough means extending below said compartment for channeling melted ice, said trough means being adapted to receive melted ice from said first storing means and from said second storing means.

15. The apparatus of claim 12, further including ice making means disposed to communicate with said first storage means to dispense a quantity of ice therein.

16. The apparatus of claim 12, wherein said first storage means includes a hopper assembly having retractable gate means movable between opened and closed positions for selectively permitting a quantity of ice to be dispensed therefrom when in its open position, said gate means when in its closed position being adapted to receive melted ice and deliver said melted ice to said drainage means.

17. The apparatus of claim 14, wherein said trough means includes at least two horizontally disposed gutter members, said members being sloped to provide direction for said melted ice flow, wherein at least one said gutter member is provided to drain into a second gutter means.

18. The apparatus of claim 17, wherein said second storing means is adapted to drain into said second gutter member; said second gutter having an outlet for drainage of fluid therefrom to the outside of said apparatus.

* * * * *